US008075463B2

(12) United States Patent
Mills et al.

(10) Patent No.: US 8,075,463 B2
(45) Date of Patent: Dec. 13, 2011

(54) EXERCISE DEVICE

(75) Inventors: Alden M. Mills, Kentfield, CA (US); John G. Holland, Anaheim, CA (US); Kevan Hollenback, Oakland, CA (US); Mark Eastwood, Kentfield, CA (US); Jeff W. Sand, San Francisco, CA (US); Ian C. MacColl, Mill Valley, CA (US); Stephen G. Hauser, Tarzana, CA (US); Lucas B. Ainsworth, Scotts Valley, CA (US)

(73) Assignee: Implus Footcare, LLC, Durham, NC (US)

( * ) Notice: Subject to any disclaimer, the term of this patent is extended or adjusted under 35 U.S.C. 154(b) by 0 days.

(21) Appl. No.: 12/764,998

(22) Filed: Apr. 22, 2010

(65) Prior Publication Data

US 2010/0273617 A1 Oct. 28, 2010

Related U.S. Application Data

(60) Provisional application No. 61/171,813, filed on Apr. 22, 2009.

(51) Int. Cl.
*A63B 26/00* (2006.01)

(52) U.S. Cl. ..... 482/140; 482/142

(58) Field of Classification Search ..... 482/55, 482/56, 140, 142, 95, 96, 123, 129–131; 5/620, 632, 648, 650
See application file for complete search history.

(56) References Cited

U.S. PATENT DOCUMENTS

| | | | | |
|---|---|---|---|---|
| 2,733,922 | A * | 2/1956 | Diego | 482/96 |
| 4,589,656 | A * | 5/1986 | Baldwin | 482/59 |
| 5,393,280 | A * | 2/1995 | Haviv | 482/56 |
| 5,492,520 | A | 2/1996 | Brown | |
| 5,498,222 | A * | 3/1996 | Hur | 482/112 |
| 5,577,987 | A | 11/1996 | Brown | |
| D390,288 | S | 2/1998 | Fingleson et al. | |
| 5,871,425 | A * | 2/1999 | Gvoich | 482/140 |
| D406,286 | S | 3/1999 | Chen | |
| 6,213,923 | B1 * | 4/2001 | Cameron et al. | 482/142 |
| 6,312,366 | B1 * | 11/2001 | Prusick | 482/130 |
| D456,084 | S | 4/2002 | Smith | |
| 6,716,144 | B1 | 4/2004 | Shifferaw | |
| 6,764,431 | B2 * | 7/2004 | Yoss | 482/56 |
| 6,790,194 | B1 * | 9/2004 | Katane et al. | 602/36 |
| 7,160,234 | B2 * | 1/2007 | Dise | 482/142 |
| 7,198,592 | B1 * | 4/2007 | Mancini | 482/140 |
| 7,207,932 | B1 * | 4/2007 | Dean | 482/140 |
| 2007/0149373 | A1 * | 6/2007 | Dalebout et al. | 482/142 |
| 2007/0254788 | A1 * | 11/2007 | Nam | 482/140 |
| 2007/0287618 | A1 | 12/2007 | Verheem | |
| 2008/0058183 | A1 * | 3/2008 | Younane et al. | 482/140 |
| 2009/0011911 | A1 * | 1/2009 | Lee | 482/142 |
| 2009/0227435 | A1 * | 9/2009 | Pandozy | 482/142 |
| 2010/0154121 | A1 * | 6/2010 | Swain, Jr. | 5/620 |
| 2010/0197471 | A1 * | 8/2010 | Hayes et al. | 482/140 |

* cited by examiner

*Primary Examiner* — Allana Lewin
(74) *Attorney, Agent, or Firm* — Charter IP LLC; Matthew J. Lattig

(57) ABSTRACT

An exercise device for achieving desired abdominal contractions during exercise movement includes a back support and a pair of leg blades removably attached to the back support. The device includes an adjustable back blade attached to the back support and extending upward from the lower end along a centerline of the back support, and a neck support assembly attached to the back blade.

23 Claims, 13 Drawing Sheets

EXERCISE DEVICE

PRIORITY STATEMENT

The present application claims the benefit under 35 U.S.C. §119(e) of U.S. Provisional Patent Application Ser. No. 61/171,813 to Alden M. Mills et al., filed Apr. 22, 2009 and entitled "EXERCISE DEVICE", the entire contents of which is hereby incorporated by reference herein.

BACKGROUND

1. Field

Example embodiments of the present invention in general relate to exercise devices for performing abdominal and lower back, or "core" exercises.

2. Related Art

In general, exercise machines provide resistance against movement of a user in order to strengthen the user's muscles. In conventional abdominal exercise techniques such as sit-ups, crunches and/or hyperextension exercises, the user is not protected for the entire range of motion. Additionally, with these conventional techniques the user may not stop upward movement at the desired maximum angle of inclination from vertical, which is recommended by doctors at no more than 30 degrees. This reduces the effectiveness of the abdominal exercise, and may cause unnecessary strain or injury to the lower back.

Thus, conventional techniques fail to provide adequate support and controlled resistance to the user. These techniques lack an effective means to control the resistance and motion of the user so as to maximize the effectiveness of the exercise and reduce the chance of injury due to an improperly performed repetition.

Further, of the conventional machines for use in exercising and strengthening a user's abdominal and back muscles by providing resistance to the user's movements, many permit only certain muscles of the abdominal and back muscle groups to be exercised, while other muscle groups are not attended to during the exercise. Moreover, some of these machines do not support the user's back during exercise, leading to hyperextension injuries.

Another issue which reduces the viability of abdominal exercise machines is size. Many currently available machines take up a substantial amount of usable space and/or cannot be easily stowed in a smaller area. This limits the user from storing and/or locating such machines at their home residence.

SUMMARY

An example embodiment of the present invention is directed to an exercise device. The device includes a back support, a chassis attached to an underside of the back support, a pair of adjustable leg blades removably attached to the chassis, an adjustable back blade removably attached to the chassis and extending upward from the chassis along a rear centerline of the back support, and a neck support assembly attached to the back blade.

Another example embodiment is directed to an exercise device having a chassis for supporting a user's weight thereon, a pair of adjustable leg blades removably attached to the chassis, and an adjustable back blade removably attached to the chassis and extending upward from the chassis along a rear centerline of the back support. Each of the back blade and leg blades has identical latch members formed at ends thereof. The device includes a neck support assembly attached to the back blade. The chassis includes a plurality of spaced slots on a rear side thereof shaped so as to receive one of the latch members of the back blade and leg blades so as to form an interference fit. The neck support assembly has a slot identical to one of the spaced slots on the chassis to receive a latch member of the back blade to form an interference fit.

Another example embodiment is directed to a leg assembly of an exercise device designed to exercise the core muscles of a user, the device having a chassis attached to an underside of a back support for the user. The leg assembly includes a pair of flexible, elongate and generally flat leg blades movable by the user up and down from a generally prone position on the back support, and a foot securing means for securing a user's feet to the leg blades. Each leg blade is removably attached to the chassis at a first end and extends downward to a second end that terminates at the foot securing means.

Another example embodiment is directed to a neck support assembly of an exercise device that has a chassis attached to an underside of a back support for supporting the weight of a user thereon. The neck support assembly includes a base attached to the back support, and a pair of spaced arms that extend upward and rearward from the base to a first point. Each arm cants forward and upward at the first point to a second point to form handle grips, each arm turning downward and inward at the second point so as to meet, forming a generally curved cradle to support the back of a user's neck.

Another example embodiment is directed to an exercise device. The device includes a back support for supporting the weight of a user thereon, a chassis attached to an underside of the back support, and an adjustable back blade removably attached to the chassis at a lower end thereof and extending upward from the chassis along a rear centerline of the back support. The device includes a clicker device attached to the back blade for imparting an audible or tactile response to indicate that the user has reached a desired exercise position or exercise orientation on the device, a cushion pad attached to a rear side of the back support so as to sandwich the chassis, back blade and clicker device there between, and a neck support assembly attached to an upper end of the back blade.

BRIEF DESCRIPTION OF THE DRAWINGS

Example embodiments of the present invention will become more fully understood from the detailed description given herein below and the accompanying drawings, wherein like elements are represented by like reference numerals, which are given by way of illustration only and thus do not limit the example embodiments.

DETAILED DESCRIPTION

The example embodiments as to be described hereafter relate to an exercise device for performing abdominal and lower back, or "core" exercises to strengthen an individual's core muscle groups. Unless otherwise defined below, terms used to describe the example embodiments should be understood for their plain meaning.

Figure 1:
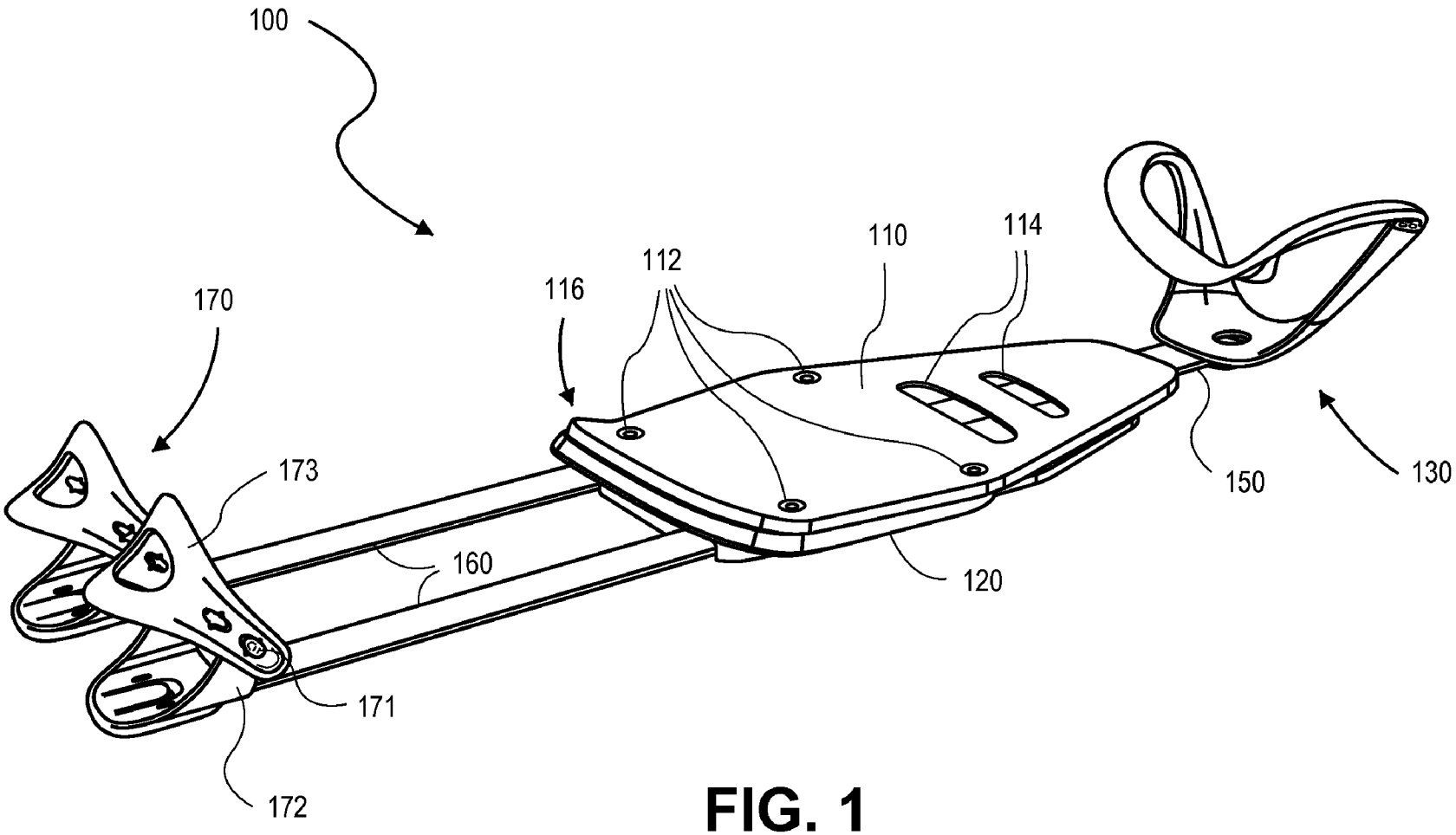
FIG. 1 is a perspective view of an exercise device in accordance with the example embodiments.
Figure 2:
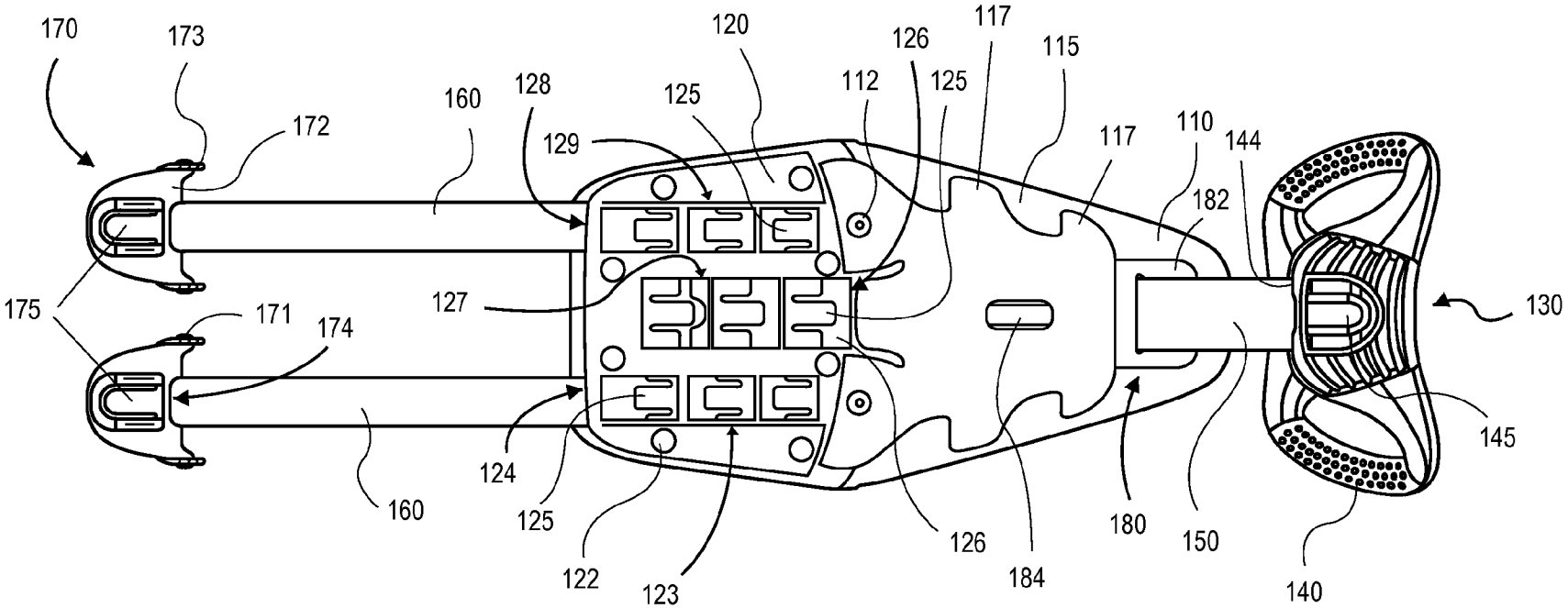
FIG. 2 is a bottom plan view thereof.
Figure 3:
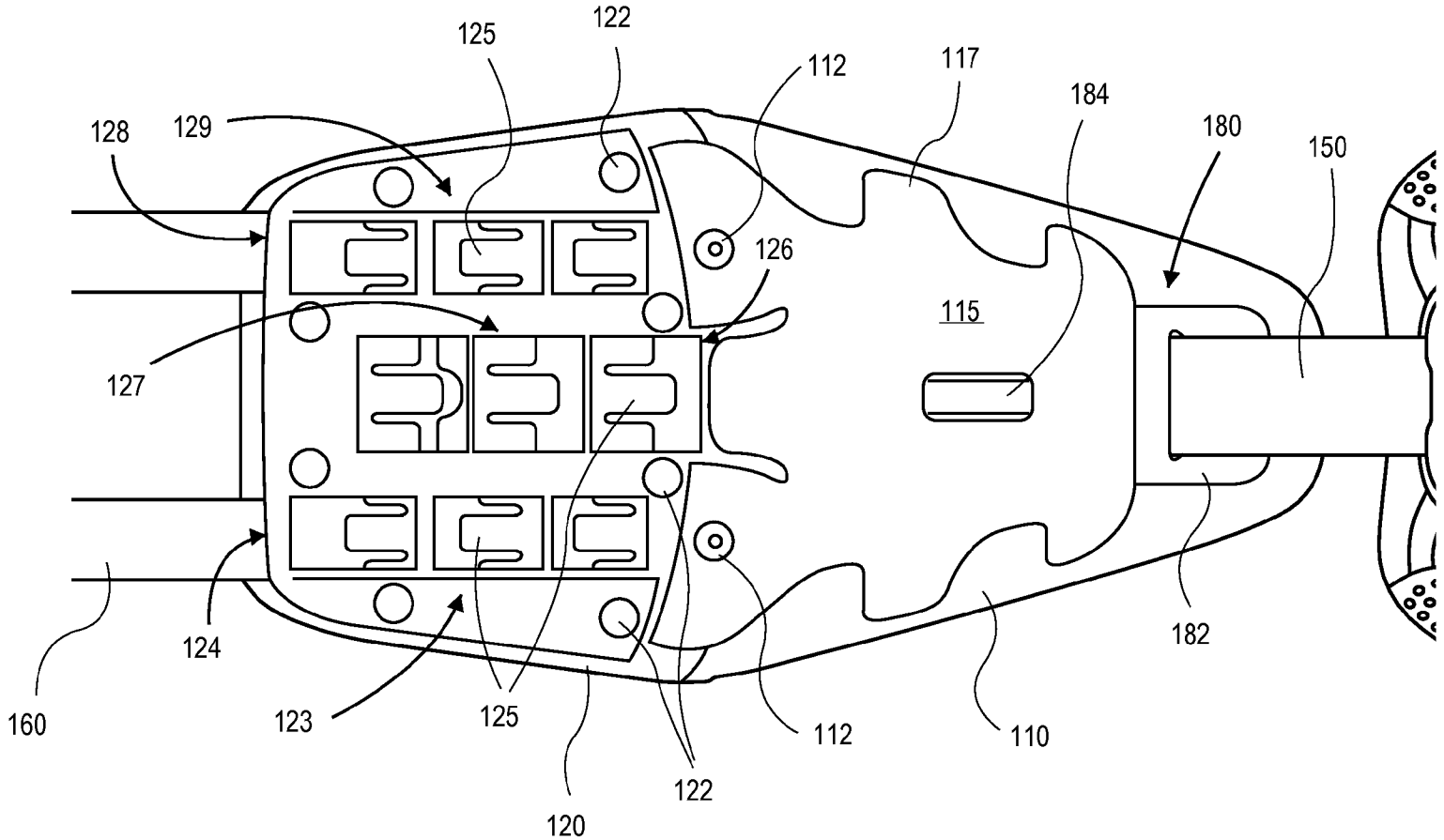
FIG. 3 is close-up enlarged bottom view of a portion of the exercise device of FIG. 1.
Figure 4:
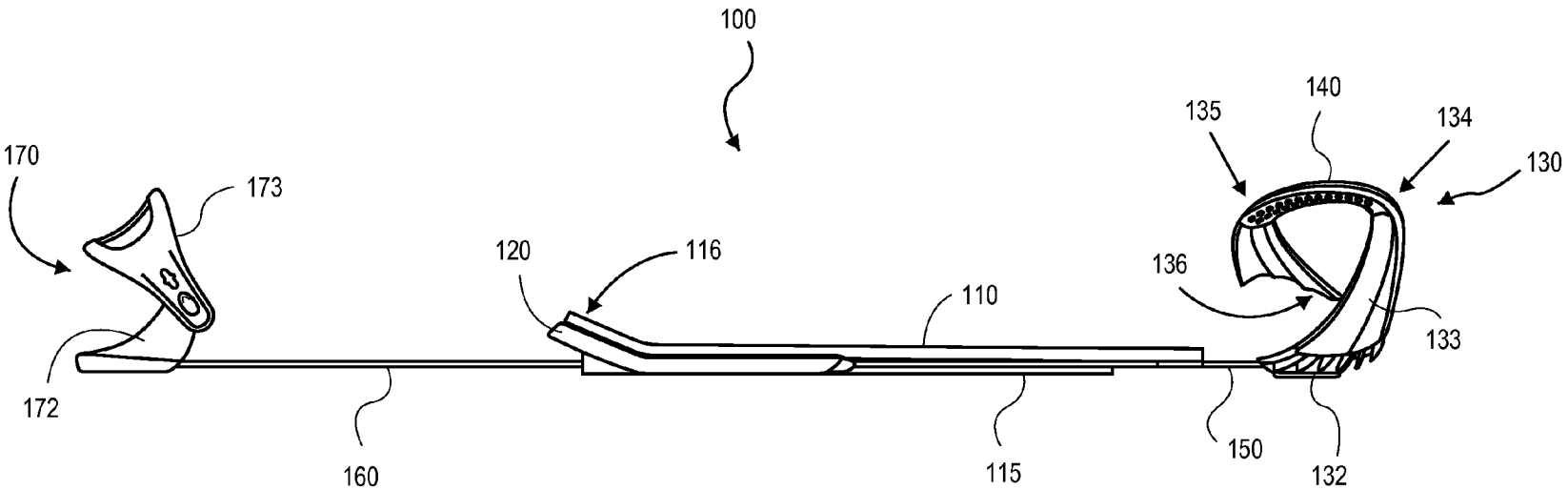
FIG. 4 is left-side elevational view thereof.
Figure 5:
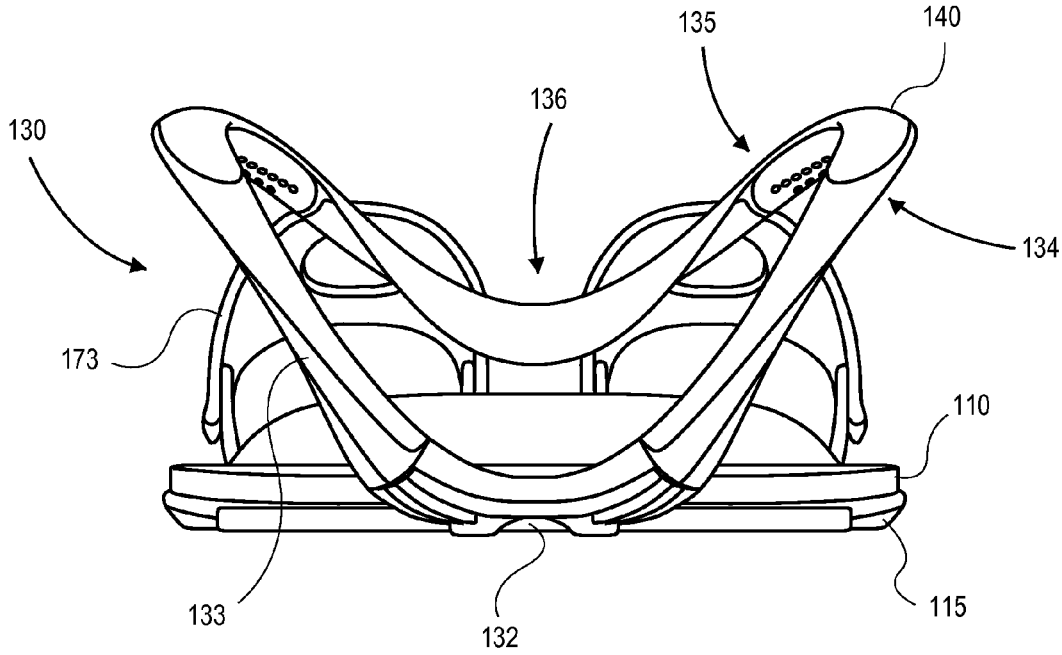
FIG. 5 is a rear elevational view thereof.

FIG. 1 is a perspective view of an exercise device in accordance with the example embodiments; FIG. 2 is a bottom plan view thereof; FIG. 3 is close-up enlarged bottom view of a portion of the exercise device of FIG. 1; FIG. 4 is left-side elevational view thereof; and FIG. 5 is a rear elevational view thereof. Referring to FIGS. 1-5, the exercise device 100 is designed to permit a user to perform ideal abdominal and lower back exercise movements to strengthen the user's core. Device 100 generally extends in a horizontal plane so that a user may perform various exercises to strengthen the lower back and abdominal muscle groups.

Device 100 includes a back support 110 that is attached to a chassis 120. The back support is ergonomically shaped to conform to the individual's spine. The back support 110 supports both the back and trunk, as seen by the wider surface area in FIG. 1, and may include a plurality of vents 114 for breathability. In an example, the back support 110 can be fabricated from a suitable foam rubber such as ethylene vinyl acetate (EVA) foam. The EVA foam may include an antimicrobial agent, or the back support 110 can include an antimicrobial material on a surface thereof, such as a cover sewn or placed over foam.

As best shown in FIGS. 2 and 3, a second or bottom pad 115 sandwiches an upper portion of the chassis 120 and the back blade 150 between itself and the back support 110. The bottom pad 115 may be made of a foam rubber material such as EVA foam for example, and optionally may include a plurality of scalloped ribs 117. The bottom pad 115 also covers a clicker device 180 which is attached to the back blade 150 and extends downward along the back blade 150. As to be described in more detail hereafter, the clicker device 180 includes a plastic member 182 with a length of metal tape 184 attached thereto for imparting an audible or tactile response to indicate that a user has reached a desired exercise position or exercise orientation on the device 100.

The bottom of the back support 110 may be flared slightly upward (shown generally at 116), which is due to the lower shape of chassis 120 so as to conform ergonomically to the user's rear. The back support 110 also may have a pelvic tilt of at least 3 degrees upward along its top surface from the head to the foot (i.e., higher towards the legs, lower towards the head), and up to about a 45 degree upward tilt at its flared bottom end, designated generally by arrow 116.

The chassis 120 serves as a base for the back support 110, as well as for providing a fixture point for a central back blade 150 and the leg blades 160. The chassis 120 may be formed from high-density polyethylene (HDPE) a well know plastic (known as #2 plastic, a well-known material used for gallon milk jugs), or from a medium heavy gauge impact plastic such as acrylonitrile butadiene styrene (ABS) or polypropylene, for example.

As best shown in FIGS. 2 and 3, the rear of chassis 120 includes a pair of spaced outer columns 123 and 129. Each outer column 123, 129 include a plurality of vertically aligned flexible tongues 125 in spaced relation to one another for securing an end of a corresponding leg blade 160 thereon via a corresponding slot 124, 128. The slots 124, 128 are dimensioned so as to accommodate different thickness blades 160, and the vertical stacking of the slots with tongues enable a plurality of differing leg blade 160 lengths for the device 100. The chassis 120 further includes a central column 127 of vertically aligned flexible tongues 125 in spaced relation to one another for securing an end of the back blade 150 therein via a corresponding slot 126. The slots 126 in the column 127 are dimensioned so as to accommodate different thickness blades 160, and the vertical stacking of the slots with tongues in column 127 similarly enable a plurality of differing back blade 150 lengths for the device 100. The variability of back blade 150 and leg blade 160 lengths, relative to the chassis 120, provide a device 100 which accommodates a wide range of user height, leg length and or trunk length, for example.

A neck support assembly 130 is attached to the top of the back blade 150. The neck support assembly 130 includes a neck support and a handle 140. Due to the geometry of the device 100, a user gripping the handle 140 to perform an exercise movement is limited by a combination of the chassis 120, back blade 150 and neck support assembly 130 to achieving an angle from horizontal of 30 degrees or less. This is the maximum angle recommended by doctors when performing an abdominal exercise such as a sit-up or crunch. As best shown in FIG. 2, the neck assembly 130 includes a flexible tongue 145 for capturing the end of back blade 150 that is received through a corresponding slot 144. The dimensions of the slot 144 and tongue 145 are identical to slots 124, 126, 128 and tongues 125.

Referring to FIGS. 4 and 5, the neck support assembly 130 includes a base 132 connected to the top of the back blade 150. A pair of spaced arms 133 is connected to the base 132. Each arm 133 extends upward and rearward from the base 132 to a first point (shown generally at 134). Each arm 133 then cants slightly forward and upward from first point 134 to a second point (shown generally at 135) to form the hand grip areas of the handle 140. Each arm 133 then turns downward and inward at second point 135 so as to meet and form a generally curved cradle 136 to support the back of the user's neck.

The base 132 and arms 133 (inclusive of handle 140) may be made of a suitable hard plastic such as ABS, for example. The portion forming the cradle 136 may be formed of a slightly softer, more malleable plastic such as thermoplastic rubber (a well known commercial material being TPR65, with 65% fiberglass constituent component thereof). Accordingly, the cradle 136 is flexible so as to move with the user thereon.

The neck support assembly 130 thus acts as a hammock. As shown in FIGS. 1-5, the device 100 geometry permits the neck support assembly 130 to move down (during a user movement) towards the user's shoulders without binding. This is possible because the length of the back blade 150 remains constant through the movement while the back chord lengthens. If the device 100 did not behave this way, the neck support assembly 130 would come down into the shoulders and limit the user's motion.

The back blade 150 extends upward from its bottom end in the chassis 120 along a centerline of the back support 110. The back blade 150 is adjustable and is in movable contact with both an underside of the back support 110 and a top surface of bottom pad 115. In an example, the back blade 150 is adjustable as explained above to vary the distance between the neck support assembly 130 and the top of the back support 110. The back blade is attached to the clicker device 180 via adhesive surfaces (not shown) on plastic member 182.

The back blade 150 may be made of a suitable metal material such as stamped spring steel, although alternatively may be made of a carbon-fiber composite, fiberglass/metal composite or other material that exhibits flexibility. Hence, back blade 150 is flexible and facilitates lateral movement of the back support 110 as the user grips the handle 140 and moves upward during exercise. Further, the back blade 150 provides resistance to this upward motion. Moreover, the back blade 150 may be configured to support the rotating motion of a "bicycle" movement by the user.

A leg assembly extends from a lower end of the back support 110. Each leg assembly comprises a leg blade 160 that terminates in a foot securing means 170. The leg blades 160 are flexible so as to permit a user to move their legs up and down from a generally prone position on the device 100. Like the back blade 150, the leg blade 160 may be made of stamped spring steel, a carbon-fiber composite, fiberglass/metal composite or other material that exhibits flexibility. Hence, the leg blades 160 facilitate both up and down movement of the legs as well as slight lateral movement of the back support 110 as the user grips the handle 140 and moves upward during exercise. Further, the leg blades 150 provide resistance to upward motion and with the back blade 150 can support the rotating motion of a "bicycle" movement by the user.

Each leg blade 160 terminates at a foot securing means 170. As shown best in FIGS. 2-4, the foot securing means 170 includes a foot base 172 and an adjustable foot strap 173 removably attachable to the base 172. The strap 173 fits over a pair of posts 171 formed in the foot base 172. Further, the foot base 172 includes a slot 174 for securing a latch member (not shown) that is formed in an end of the leg blade 160 therein. As to be described hereafter, the slot 174 includes a flexible tongue 175 formed in the base 172, which under tension flexes so as to engage the latch member of the leg blade 160 to form an interference fit therewith.

Accordingly, the back blade 150 is adjustable in the central column 127 of the chassis 120 to vary the distance between the neck support assembly 130 and top of the back support 110. Further, each leg blade 160 is adjustable within the chassis 120 to alter the length of the leg blade 160 from the back support 110 to the foot securing means 170. For example, the leg blade 160 can be adjustable between about 15 to 23 inches in length to allow a user to engage different muscle groups. This may also provide an ergonomic benefit for different users.

Additionally, the maximum length of the leg blade 160 could potentially become an issue with respect to packaging the device 100 for transport and/or retail sale. Many large global retailers utilize standard size box packaging, one of with is a box having a length of 24 inches. As the leg blade 160 is the longest component in the device 100, an example leg blade 160 length is less than or equal to 23 inches.

Further, each of the slots 124, 126, 128, 144, 174 is adapted to receive different thickness blades 150/160 for different resistances. Accordingly, a back blade 150 or leg blades 160 having varying thicknesses can be utilized in the chassis 120 and/or with the neck support assembly 130 and/or foot base 172 to provide different resistances to the user.

Figure 6:
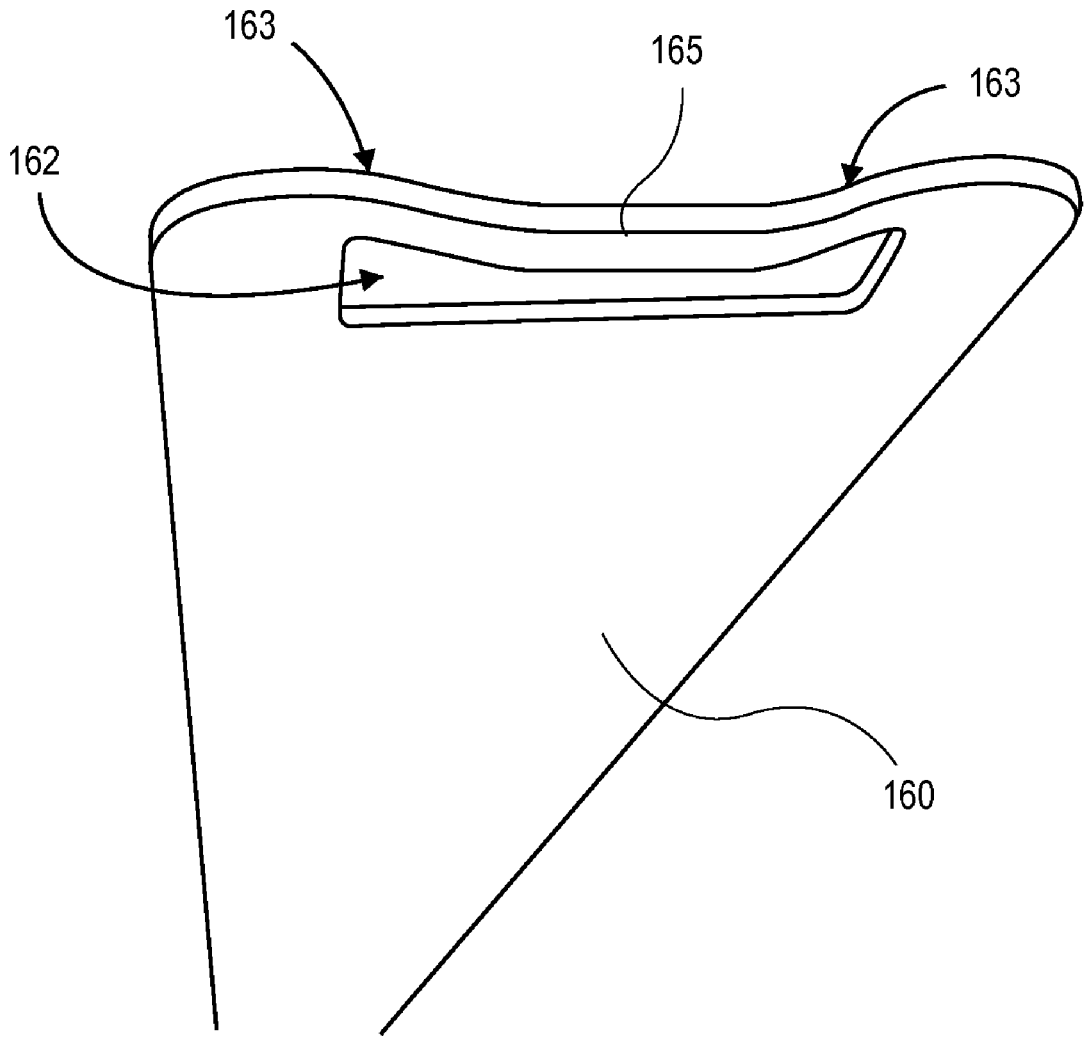
FIG. 6 is an end-on view of a portion of a leg blade to illustrate the latch member in more detail.

FIG. 6 is an end-on view of a portion of a leg blade to illustrate the latch member in more detail. In FIG. 6 an end portion of a leg blade 160 is provided to illustrate the latch member 165 which is designed to engage the flexible tongues 125, 175 in the slots 123, 129 of the chassis 120 or slot 174 of the foot base 172. The end of leg blade 160 is configured with a latch member 165 that has a canted or angled profile (shown generally at angled portions 163) that is designed to be inserted into an alignment channel within any one of the slots 124, 126, 128, 174 for engagement with an associated flexible tongue 125, 175. The aperture 162 formed in the leg blade 160 enables the latch member 165 to be fixedly captured within the tongue 125/175, as to be described in more detail hereafter. The back blade 150 has the identical latch member 165 configuration at either end thereof.

Figure 7:
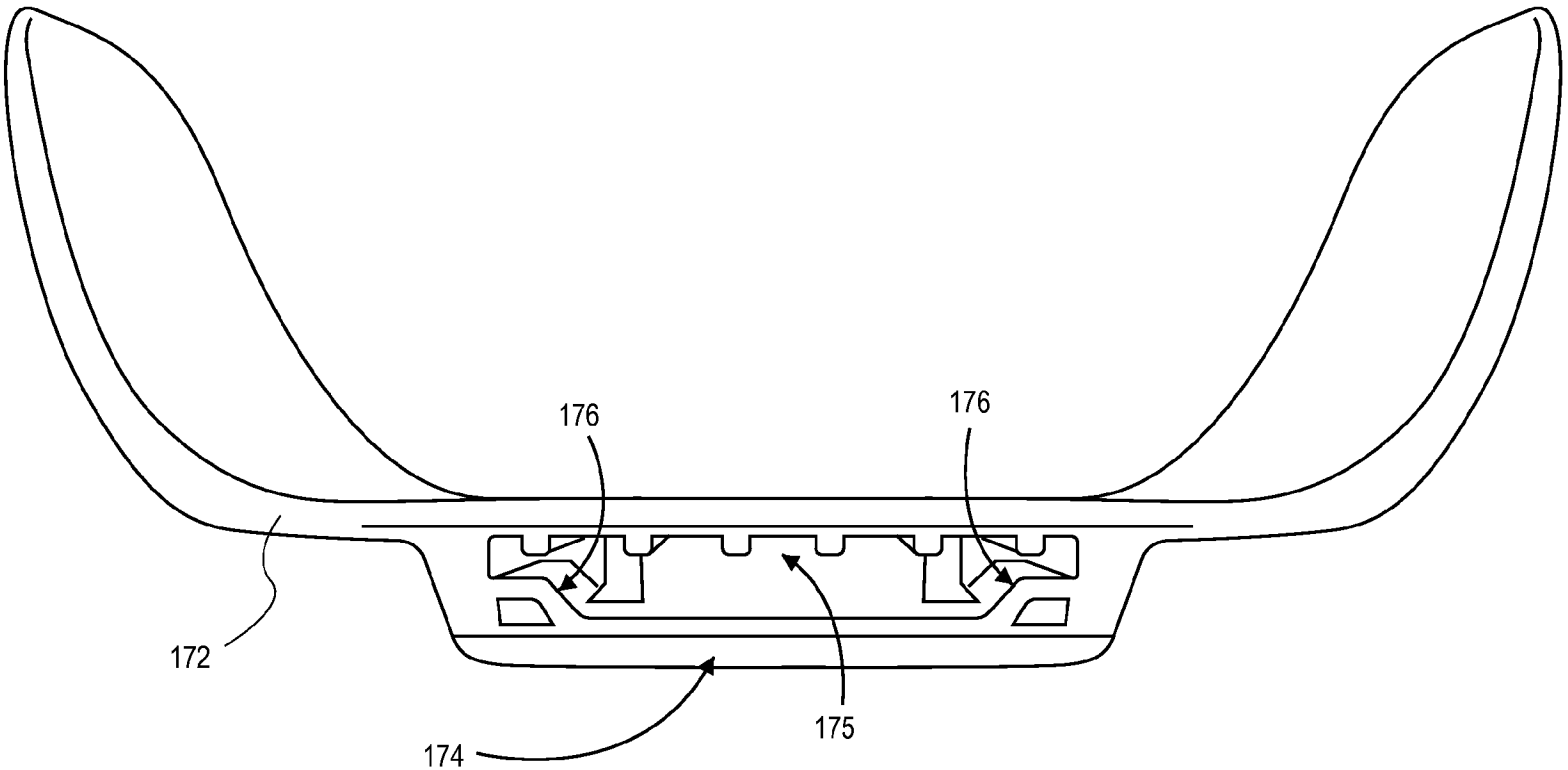
FIG. 7 is a front plan enlarged view of part of the base of the foot securing means to illustrate the slot and flexible tongue in further detail.
Figure 8:
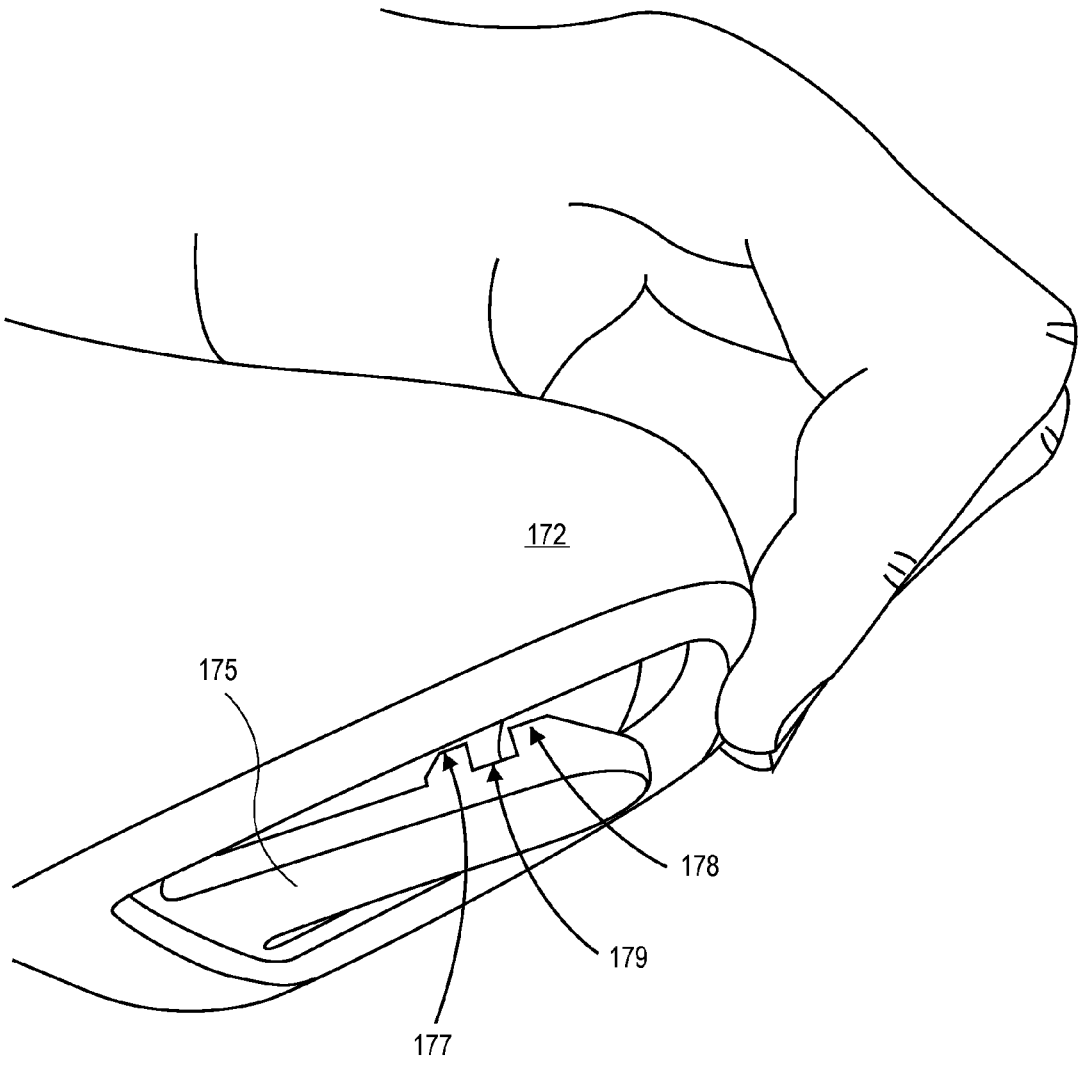
FIG. 8 is a top plan view of the base to illustrate features of the flexible tongue in more detail.

FIG. 7 is a front plan enlarged view of part of the base of the foot securing means to illustrate the slot and flexible tongue in further detail; and FIG. 8 is a top plan view of the base to illustrate features of the flexible tongue in more detail. The interference fit relationship between the latch member 165 and flexible tongue 125/145/175 is identical in each of the chassis 120, foot base 172 and neck support assembly 130. The following example describes the connective engagement of a leg blade 160 into (or out of) a foot base 172.

Referring to FIGS. 7 and 8, each slot (her slot 174 in foot base 172) is dimensioned to receive an end of the leg blade 160 with its mirror profile latch member 165 configuration. For example, angled ridges 176 act as alignment guides for the angled portions 163 of the latch member 165. The flexible tongue 175 can be seen within the opening of slot 174. As best seen in FIG. 8, the tongue 175 can be depressed by the user to enable the latch member 165 to travel over latch stop 177 so that the latch member 165 snap fits into recess 179 in the tongue 175. Second stop 178 acts to limit travel of the leg blade 160, with the latch member 165 secured in the recess 179 and the latch stop 177 extending within the aperture 162 of the leg blade 160.

In an example, the tongue 175 has sufficient give to enable the leg blade 160 to be inserted into the slot 174 such that the latch member 165 overcomes the tension of the tongue 175 so as to engage the recess 179 in a snap fit engagement. To remove the leg blade 160 (or back blade 150), the user simply depresses the tongue 175 to remove the stops 177/179 and recess 178 from the latch member 165, and then simply slides the leg blade 160 out of slot 174.

Figure 9:
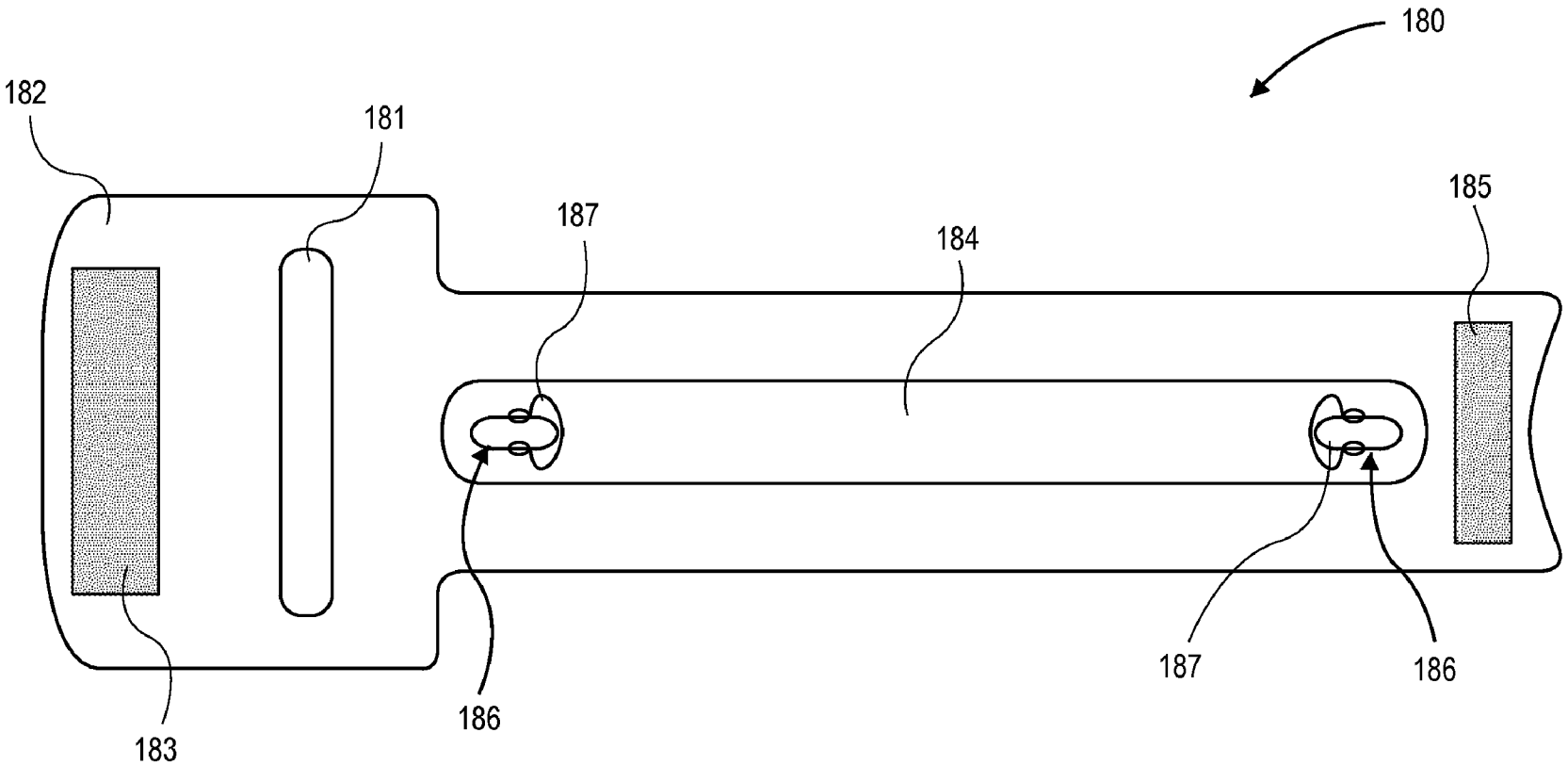
FIG. 9 is a top plan view of the clicker device.

FIG. 9 is a top plan view of the clicker device. With occasional reference to FIGS. 2 and 3, the clicker device 180 includes an elongate plastic member 182 attached lengthwise to a portion of the back blade 150. The plastic member 182 has a length of metal tape 184 thereon, much like the metal of a measuring tape. The tape 184 flexes under user actuation on the back support 110 during an exercise repetition to impart the audible or tactile response once the desired exercise position or orientation has been reached.

Each end of the clicker device 180 includes an adhesive strip 183, 185 to attach the device 180 to the back blade 150. Opening 181 enable the clicker device 180 to be slid onto the back blade 150 before the back blade 150 top end is attached to the neck support assembly 130. The plastic member 182 includes a pair of spaced projections or bosses 186 that extend through holes 187 formed in the metal tape 184 to fixedly secure the metal tape 184 to the plastic member 182.

Figure 10:
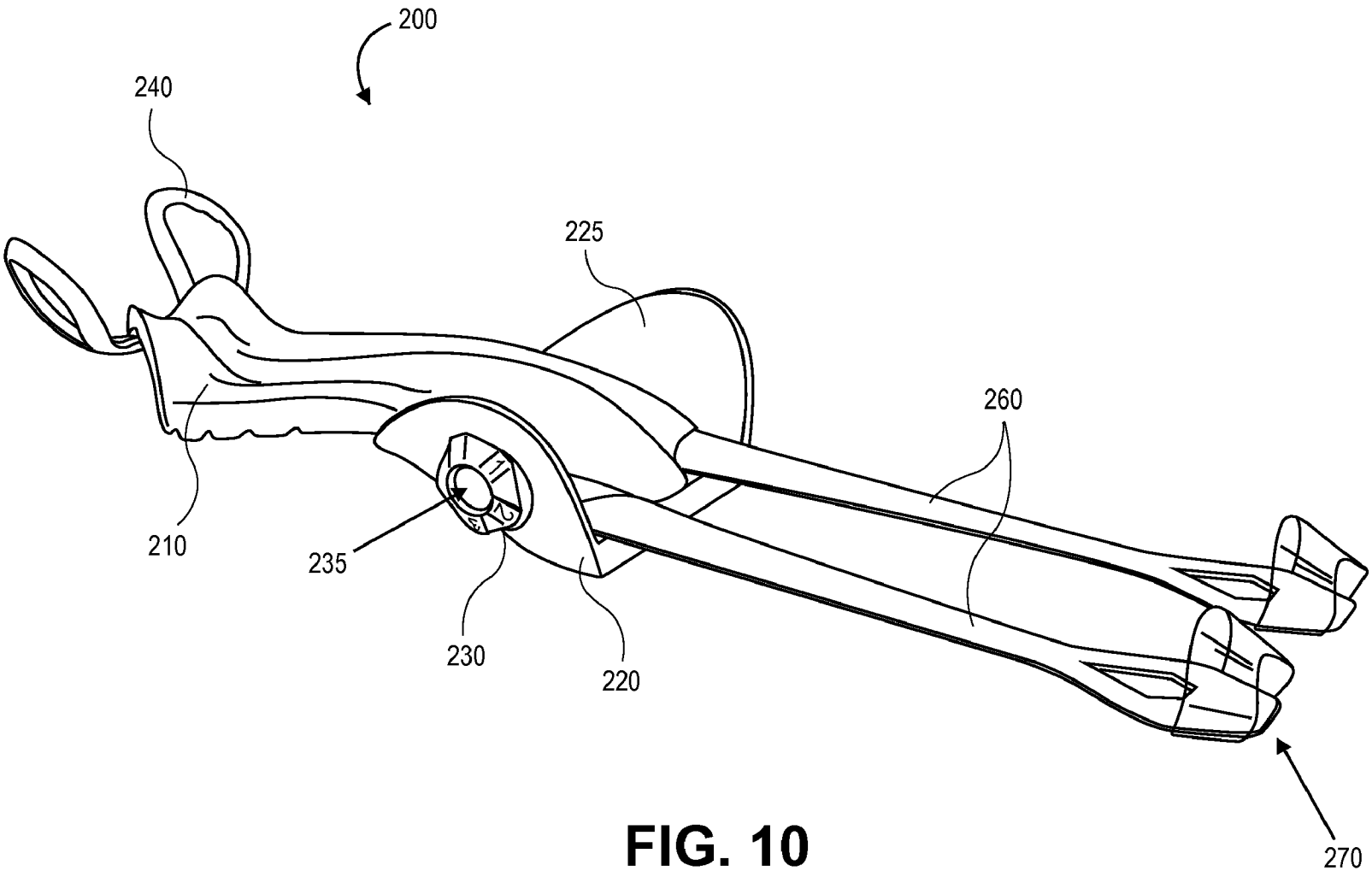
FIG. 10 is a perspective view of an exercise device in accordance with another example embodiment.
Figure 11:
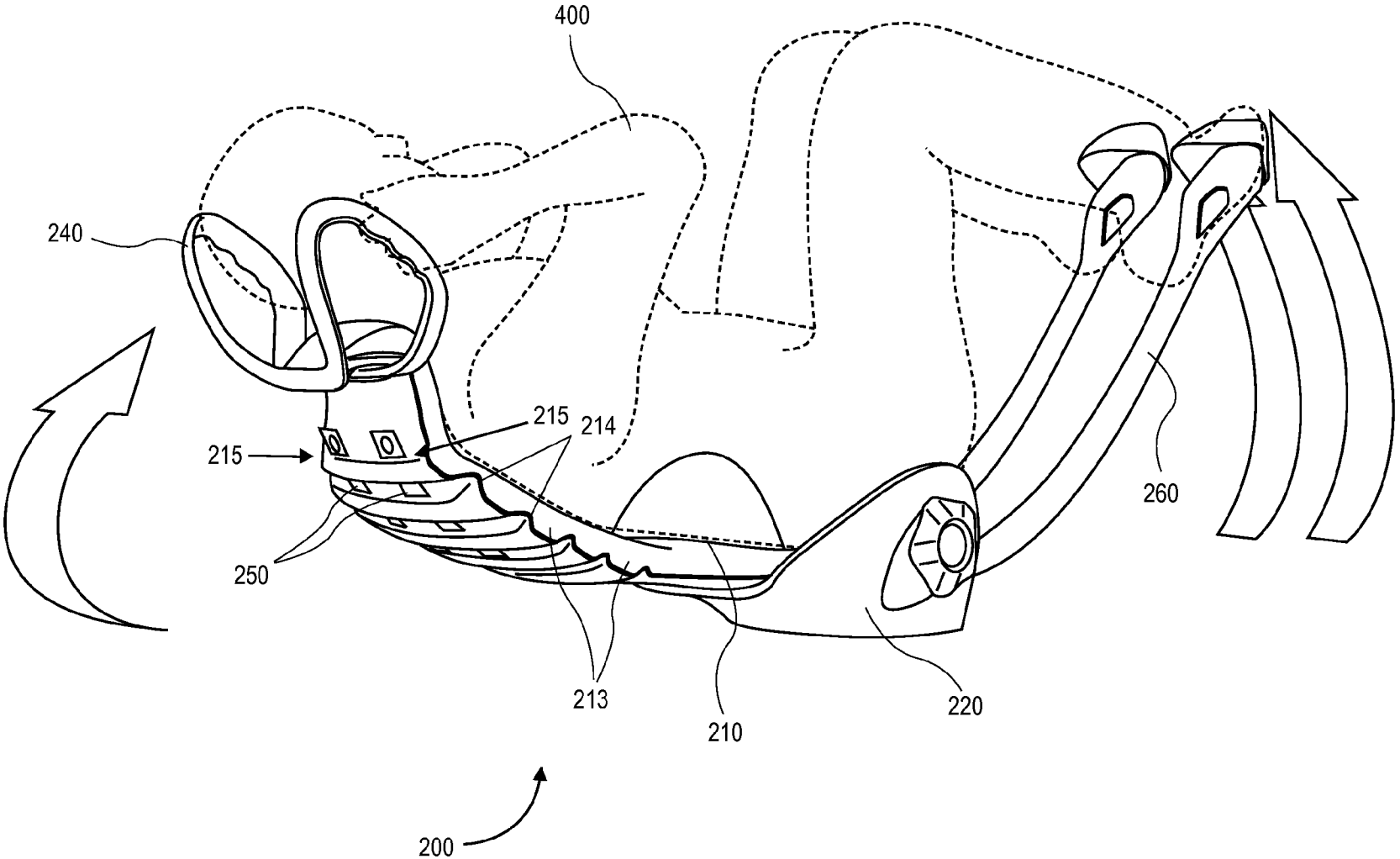
FIG. 11 is a perspective view of an exercise being performed by a user on the device of FIG. 10.

FIG. 10 is a perspective view of an exercise device in accordance with another example embodiment, and FIG. 11 is a perspective view of an exercise being performed by a user on the device of FIG. 10. As many of the components are similar to FIGS. 1-5 in both function and material construction, only the differences are noted.

Exercise device 200 includes a combination back/neck support 210, with a handle 240. The back/neck support 210 is attached to a saddle 220. The saddle 220 includes sidewalls 225 which serve as the hip pivot point of the user 400 and also help secure the user 400 on the saddle 220. An adjustable dial 230 is attached to the saddle 220 and connected to a pair of leg blades 260. The leg blades 260 are removably secured between the back/neck support 210 and saddle 220, and terminate at foot securing means 270. A release button 235 may be provided within the dial 230, as shown. The release button 235 allows the user 400 to disengage leg blades 260. For installation, the leg blades 260 can be inserted in a snap-fit or interference fit fashion within the saddle 220, for example.

The adjustable dial 230 can be configured to adjust the leg blades 260 orientation from horizontal, so as to realize multiple leg positions. In one example, position 1 can be set to 0 degrees; position 2 set to 30 degrees from horizontal; and position 3 set to 60 degrees from horizontal, etc. The different leg positions help the user 400 to focus exercise movements on different muscle groups, for example.

The back/neck support 210 may be a foam rubber article such as EVA foam. The saddle 220 and handle 240 may be made of a hard plastic such as ABS. Alternatively the handle 240 may be made of aluminum with a rubber over-mold coating. The leg blades 260 may be formed from a stamped spring steel or similar metal material, or alternatively from fiberglass or a carbon fiber material.

The rear of the back/neck support 210 has a series of spaced ribs 213 that form notches 214 in the sides of the back/neck support 210. Each rib 213 has a pair of spaced slits 215 through which extend back blades 250. The back blades 250 may be formed from a stamped spring steel or similar metal material. The back blades 250 extend down either side of the spine, so as to permit torsion movement by the user 400.

The device 200 provides ergonomic benefits. The back/neck support 210 is inflexible from the last notch 214 downward to the saddle 220, but otherwise flexible up to the handle 240 due to the back blades 250. The back/neck support 210 top surface is shaped so as to support the user 400's neck and spine comfortably.

Figure 12A:
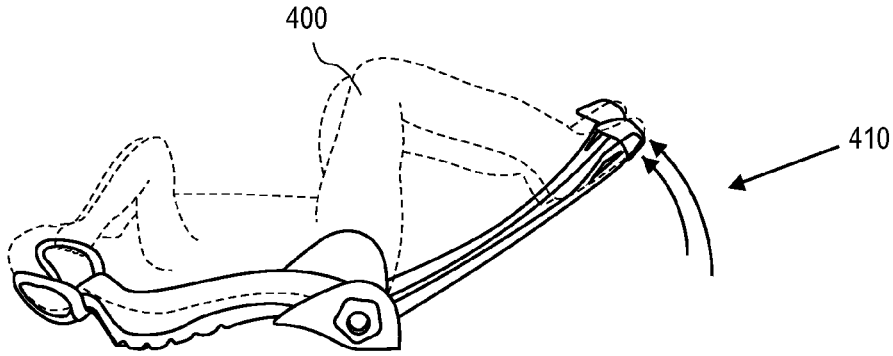
FIGS. 12A through 12C shows various views of example exercises that can be performed by a user with the devices of FIG. 1 and FIG. 10.
Figure 12B:
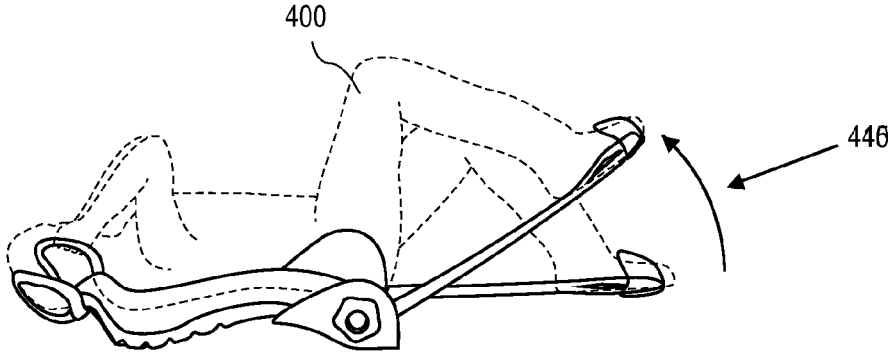
Figure 12C:
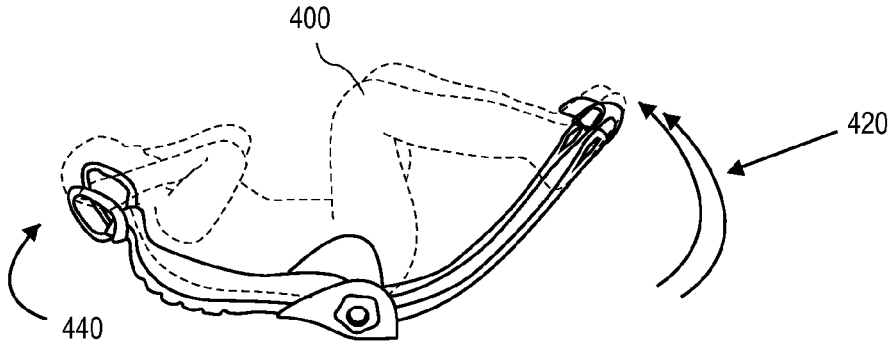

FIGS. 12A through 12C shows various views of example exercises that can be performed by a user with the devices of FIG. 1 and FIG. 10. Referring to FIG. 12, there are shown exercise movements A, B and C. In exercise movement A, the user 400 is performing an exercise to focus on the muscle groups in the lower back. The arrows 410 denote that the user is performing a "both legs down" repetition, contracting the lower back by moving the legs downward. This view illustrates some of the flexibility of the leg blades 260.

In exercise movement B, the user 400 is performing an exercise to focus on the muscle groups in the lower abdomen, an "alternating legs up" repetition. Here, the user 400 is moving his legs in opposite directions, or twisting his upper body side to side. This movement can be used as part of a full abdominal movement exercise. In exercise movement C, the user 400 is performing an exercise to focus on the muscle groups in the full abdominal region and the lower back, a "both legs up and sit-up" repetition. Here, the user 400 is contracting his lower abdominal muscles moving his legs up together (arrow 420), and also contracting his upper abdominal muscles by moving his body to the up position (arrow 430). For each of these exercises the user 400 is limited by the geometry of device 200 to no more than a 30 degree inclination angle upward from horizontal.

Figure 13:
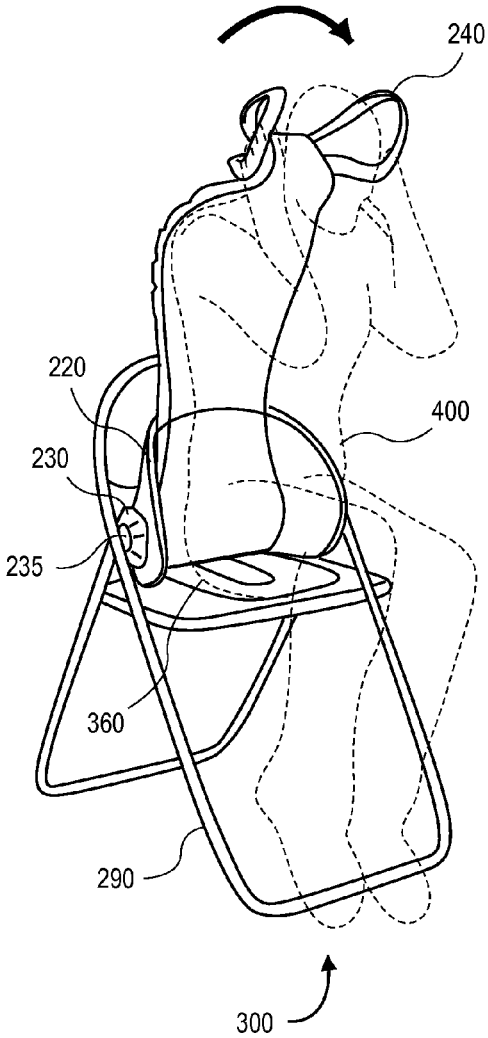
FIG. 13 is a perspective view of an exercise device in accordance with another example embodiment.
Figure 14:
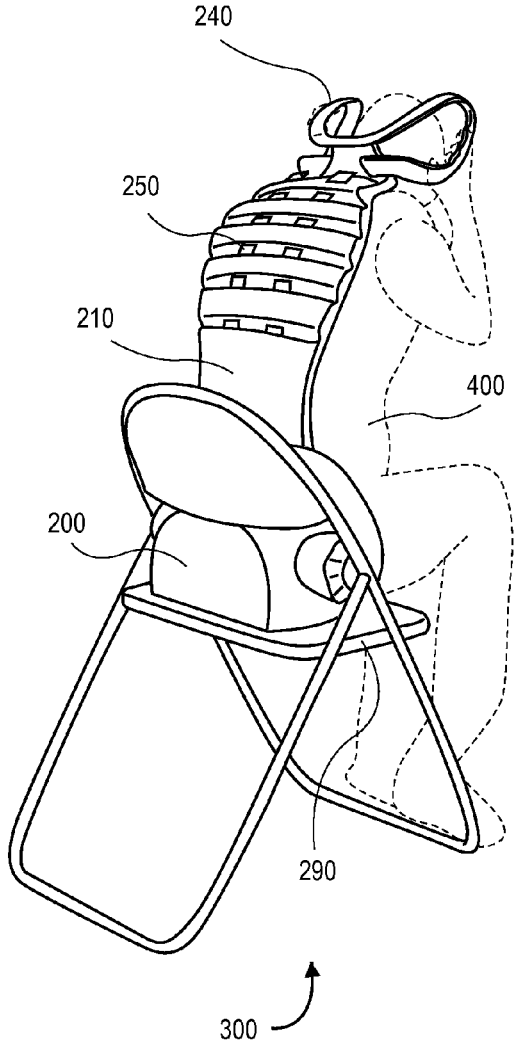
FIG. 14 is a rear view of the device in FIG. 13.

FIG. 13 is a perspective view of an exercise device in accordance with another example embodiment, and FIG. 14 is a rear view of the device in FIG. 13. Unlike the previous embodiments, device 300 is configured for exercise in the seated position. This provides a device that makes abdominal exercises accessible to users who do not or cannot perform a "traditional" sit-up or crunch on the floor, and may be desirable for rehabilitation of individuals and/or for individuals with physical limitations. As many of the components are similar to FIGS. 1 and 10, only the differences are noted.

One notable difference is the absence of leg blades. The same device 100 or 200, absent leg blades 260, may be applicable to this embodiment; a seat blade 360 replaces the leg blades 260 of FIG. 10 (or leg blades 160 of FIG. 1). In one example, the seat blade 360 may serve as an accessory, to be purchased so as to replace leg blades 260.

To configure device 300 for exercise, the seat blade 360 is inserted into the saddle 220 so that it extends outward from the bottom of the saddle 220. The saddle 220 with back/neck support 210 attached thereto is place on a level seating surface (such as chair 390). The user 400 is placed into the saddle 220 and begins exercising by grasping the handle 240. FIG. 13 illustrates position 1 (A) and position 2 (B) in an example exercise movement.

Accordingly, unlike traditional abdominal exercise equipment, the example exercise devices enable the individual to perfect abdominal contraction. When the individual lifts his/her body and/or both legs and body simultaneously while gripping the handle, the device limits upward body movement to the 30 degree inclination angle, thereby enabling the individual to achieve the desired contraction that maximizes muscle exercise.

The ergonomic back support and neck support assembly allows the individual to remain comfortable and protected for the entire range of motion. Movements using the devices as described herein are designed so that the individual's spine curves naturally with their body, extending upward no more than the doctor-recommended inclination angle from horizontal.

The example exercise devices permit the individual to perform at least 12 movements so as to maximize the muscle exercise achieved with each movement. Several of these movements are shown in FIGS. 13 and 14. For example, to emphasize lower back movements, the user 400 may perform a "both leg down" (contracting the lower back by moving legs downward) abdominal exercise and an alternating leg down (moving legs opposite directions or twisting body side-to-side) abdominal exercise on the device. To emphasize lower abdominal movements, the user 400 may perform a "both leg up" (contracting abs by moving legs to the up position) abdominal exercise and an alternating leg down abdominal exercise on the device. Additionally, to emphasize upper abdominal movements, the user 400 may perform a "both legs" sit-up exercise and an alternating or cross sit-up exercise on the device.

For full abdominal movements, the user 400 may perform a series of four (4) exercises, such as a combination leg up and sit-up exercise, alternating sit-up and leg-up exercise, combination sit-up and leg-down exercise, and alternating sit-up and leg down exercise. Further, for full abdominal and lower back movements, the user 400 may perform a combination of sit-up, both legs up and both leg down exercises, or alternating sit-up, leg up and leg down exercises.

Accordingly, the types of ore exercises possible with the example exercise devices shown in any of FIGS. 1, 10 and 13 may include, but are not limited to: lower abdominal-focused exercises such as single leg march, bicycle, and reverse crunch; upper abdominal-focused exercises such as crunch and oblique crunch; sit-up combination exercises such as crunch+single leg march, oblique crunch+bicycle, crunch+reverse crunch, and oblique crunch+reverse crunch; bridges such as single-leg bridge and double-leg bridge, and one or more of the above with device 100 modifications, removing the leg blades 160 and/or using the device 100/200/300 on a chair without leg blades.

The example embodiments being thus described, it will be obvious that the same may be varied in many ways. The example embodiments have heretofore described an exercise device that includes the back support with chassis, neck support assembly, back blade and leg blades. An alternative embodiment is an exercise device which does not include the leg blades, i.e., a variation of FIG. 1. In this configuration (and unlike the embodiments in FIGS. 13 and 14), the user performs exercise movements from a prone position. The trunk or rear of the user acts as a weighting mechanism on the lower end of the back support 110 to prevent the device from moving/sliding along the floor. However, the user is still able to perform many of the same exercises (sit-up, twist sit-up, etc.), and the geometry of the device would still enable to user to achieve the desired inclination of no more than 30 degrees to realize maximum effectiveness out of their repetitions.

In another variation and as briefly discussed above, the slots 124, 126, 128 in the chassis 120 (or slot 144 in neck assembly 130/slot 174 in foot base 172) may be adapted to receive different thickness blades 150/160 for different resistances. For example, back/leg blades 150/160 may have a thickness in a range of between 1 mm to 2 mm, and/or different blades 150/160 may be provided with thicknesses of 1.2 mm, 1.5 mm, 1.7 mm, for example. In a further variation, the back and/or leg blades could be configured to "stack up" like a leaf spring truck suspension, for example. Such variations are not to be regarded as departure from the example embodiments of the present invention. All such modifications as would be obvious to one skilled in the art are intended to be included within the following claims.

What is claimed is:

1. An exercise device, comprising:

a back support, a chassis attached to an underside of the back support, a pair of adjustable leg blades removably attached to the chassis, an adjustable back blade removably attached to the chassis and extending upward from the chassis along a rear centerline of the back support, and a neck support assembly attached to the back blade, wherein the chassis includes a pair of spaced outer columns, each outer column having a plurality of vertically aligned slots in spaced relation to one another for securing an end of a corresponding leg blade therein, the slots of the outer columns providing a plurality of differing leg blade lengths for the device.

2. The device of claim 1, wherein each end of a leg blade and the back blade has a latch member formed thereon, the latch member configured to engage a flexible tongue so as to form an interference fit upon securing one end of a leg blade or back blade to the chassis or upon securing one end of the back blade to the neck support assembly.

3. The device of claim 1, wherein the back support includes an antimicrobial material on a surface thereof.

4. The device of claim 1, wherein the back support includes a plurality of spaced openings for ventilation.

5. The device of claim 1, wherein the back blade is flexible to provide resistance to lateral movement of the user on the back support.

6. The device of claim 1, wherein the leg blades are adjustable in length relative to the chassis so as to extend downward between about 15 to 23 inches from a lower end of the back support.

7. The device of claim 1, wherein each leg blade is adjustable to a length less than or equal to 23 inches.

8. The device of claim 1, wherein the back blade is adjustable relative to the chassis to vary the distance between the neck support and the top of the back support.

9. The device of claim 1, further comprising a foot securing means for securing a user's feet to the leg blades, the foot securing means including:

a base, and an adjustable foot strap removably attachable to the base.

10. The device of claim 9, wherein the foot securing means includes a slot for securing a latch member that is formed in an end of the leg blade therein, the slot having a flexible tongue which under tension flexes so as to engage the latch member to form an interference fit therewith.

11. The device of claim 1, wherein the chassis includes:

a central column of vertically aligned slots in spaced relation to one another for securing an end of the back blade therein, the slots of the central column providing a plurality of differing back blade lengths for the device.

12. The device of claim 11, wherein each of the slots include a flexible tongue which under tension flexes so as to engage a latch member formed in the end of the leg blade or back blade to form an interference fit with the latch member.

13. The device of claim 12, wherein the tongue has an extension that is depressible by a user to enable engagement of the latch member of a leg blade or the back blade with the tongue, or to release the latch member from the tongue in a given slot of the chassis.

14. An exercise device, comprising:

a back support, a chassis attached to an underside of the back support, a pair of adjustable leg blades removably attached to the chassis, an adjustable back blade removably attached to the chassis and extending upward from the chassis along a rear centerline of the back support, a neck support assembly attached to the back blade, the neck support assembly including a handle, and a user gripping the handle to perform an exercise is limited by the device to achieving an inclined angle from horizontal of 30 degrees or less;

wherein the back blade is flexible to facilitate lateral movement of the back blade with respect to a longitudinal axis of the back blade as the user grips the handle and moves upward or downward during exercise.

15. The device of claim 1, wherein the neck support assembly includes a generally curved cradle to conform to the back of a user's neck, the cradle sandwiched between and contiguous with a pair of arms formed into part of the neck support assembly.

16. The device of claim 1, wherein the neck support assembly includes:

a base connected to the top of the back blade, a pair of spaced arms that extend upward and rearward from the base to a first point, each arm canting forward and upward at the first point to a second point to form handle grips, each arm turning downward and inward at the second point so as to meet, forming a generally curved cradle to support the back of a user's neck.

17. The device of claim 1, wherein the neck assembly includes a slot for securing a latch member that is formed in an end of the back blade therein, the slot having a flexible tongue which under tension flexes so as to engage the latch member to form an interference fit therewith.

18. The device of claim 1, further comprising a clicker device attached to the back blade for imparting an audible or tactile response to indicate that a user has reached a desired exercise position or exercise orientation on the device.

19. An exercise device, comprising:

a chassis for supporting a user's weight thereon, a pair of adjustable leg blades removably attached to the chassis, an adjustable back blade removably attached to the chassis and extending upward from the chassis along a rear centerline of the back support, each of the back blade and leg blades having identical latch members formed at ends thereof, and a neck support assembly attached to the back blade, wherein the chassis includes a plurality of spaced slots on a rear side thereof shaped so as to receive one of the latch members of the back blade and leg blades so as to form an interference fit, the neck support assembly having a slot identical to one of the spaced slots on the chassis to receive a latch member of the back blade to form an interference fit.

20. The device of claim 19, further comprising:

a foot securing means having a slot identical to one of the spaced slots on the chassis for securing a latch member formed in an end of a leg blade therein.

21. The device of claim 20, wherein each of the slots include a flexible tongue therein which under tension flexes so as to engage a given latch member to form an interference fit therewith.

22. An exercise device, comprising:

a back support for supporting the weight of a user thereon, a chassis attached to an underside of the back support, an adjustable back blade removably attached to the chassis at a lower end thereof and extending upward from the chassis along a rear centerline of the back support, a clicker device attached to the back blade for imparting an audible or tactile response to indicate that the user has reached a desired exercise position or exercise orientation on the device, a cushion pad attached to a rear side of the back support so as to sandwich the chassis, back blade and clicker device there between, and a neck support assembly attached to an upper end of the back blade.

23. The device of claim 22, wherein the clicker device further includes a length of metal tape that flexes under user actuation of the back support, back blade and neck support assembly during a repetition to impart the audible or tactile response once the desired exercise position or orientation has been reached.

* * * * *